US008951055B2

(12) United States Patent
Eusterholz et al.

(10) Patent No.: US 8,951,055 B2
(45) Date of Patent: Feb. 10, 2015

(54) ELECTRICAL DEVICE WITH A PLUG-TYPE CONNECTOR AND ELECTRICAL PLUG-TYPE CONNECTION

(75) Inventors: Helmut Eusterholz, Paderborn (DE); Frank Best, Bückeburg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 123 days.

(21) Appl. No.: 13/703,089

(22) PCT Filed: Jun. 8, 2011

(86) PCT No.: PCT/EP2011/002801

§ 371 (c)(1),
(2), (4) Date: Dec. 10, 2012

(87) PCT Pub. No.: WO2011/154127

PCT Pub. Date: Dec. 15, 2011

(65) Prior Publication Data

US 2013/0078844 A1 Mar. 28, 2013

(30) Foreign Application Priority Data

Jun. 8, 2010 (DE) ..... 10 2010 022 987

(51) Int. Cl.
*H01R 13/64* (2006.01)
*H01R 9/18* (2006.01)
*H01R 13/631* (2006.01)

(52) U.S. Cl.
CPC ..... *H01R 9/18* (2013.01); *H01R 13/6315* (2013.01); *H01R 13/64* (2013.01)
USPC ..... 439/248; 439/378

(58) Field of Classification Search
CPC .... H01R 13/6315; H01R 13/74; H01R 13/64; H01R 13/743; H01R 13/629; H01R 24/52; H01R 12/7005; H01R 13/748; H01R 13/518; H01R 43/26; H01R 13/516; H01R 13/533
USPC ..... 439/247, 248, 374, 377–378
See application file for complete search history.

(56) References Cited

U.S. PATENT DOCUMENTS

| | | | | |
|---|---|---|---|---|
| 4,915,641 | A * | 4/1990 | Miskin et al. | 439/247 |
| 6,017,233 | A | 1/2000 | Fry et al. | |
| 6,234,817 | B1 * | 5/2001 | Hwang | 439/247 |
| 6,890,200 | B1 | 5/2005 | Wu | |
| 7,029,301 | B2 * | 4/2006 | Ootori et al. | 439/248 |

FOREIGN PATENT DOCUMENTS

| | | | |
|---|---|---|---|
| DE | 24 38 445 | A1 | 2/1976 |
| DE | 38 09 605 | A1 | 10/1989 |

(Continued)

*Primary Examiner* — Xuong Chung Trans
(74) *Attorney, Agent, or Firm* — Roberts Mlotkowski Safran & Cole, P.C.; David S. Safran

(57) ABSTRACT

Connection between an electrical device and a stationary base part, with a plug type connector which can be fixed in floating fashion to a fixing plate of the device and with a corresponding mating plug type connector which can be fixed to the base part, wherein the mating plug type connector has a housing at least one guide hole. Compensation between the plug type connector and the mating plug type connector is possible when joining the electrical device to the stationary base part by at least one screw hole being formed in the housing of the plug type connector for a fixing screw which passes through the screw hole into a fixing plate of the electrical device, the diameter of the screw head being greater than the diameter of the screw hole, and the diameter of the screw neck being substantially smaller than the diameter of the screw hole.

11 Claims, 8 Drawing Sheets

(56) References Cited

FOREIGN PATENT DOCUMENTS

| | | | |
|---|---|---|---|
| DE | 695 20 197 | T2 | 8/2001 |
| EP | 0 794 594 | A2 | 9/1997 |
| EP | 1 107 367 | A2 | 6/2001 |
| WO | 03/039220 | A1 | 5/2003 |

* cited by examiner

ELECTRICAL DEVICE WITH A PLUG-TYPE CONNECTOR AND ELECTRICAL PLUG-TYPE CONNECTION

BACKGROUND OF THE INVENTION

1. Field of the Invention

The invention relates to an electrical device for mechanical and electrical connection to a stationary base part, with a plug-type connector that can be connected to a corresponding mating plug-type connector which is attached to the base part, the plug-type connector having a housing with at least one contact insert with several contact elements. In addition the invention also relates to an electrical plug-type connection for producing an electrical connection between an electrical device and a stationary base part, with a plug-type connector which can be attached in a floating manner to a mounting plate, and a corresponding mating plug-type connector which can be attached to the base part, the plug-type connector having a housing with at least one contact insert with several contact elements and at least one guide element, and the mating plug-type connector having a housing with at least one mating contact insert with several mating contact elements and at least one second guide element which interacts with the first guide element when the plug-type connector and the mating plug-type connector are joined.

2. Description of Related Art

The initially described electrical device is preferably a relatively large and heavy electrical device which is mechanically connected to a stationary base part and is fastened on the base part. In the completion of the mechanical connection an electrical connection takes place between the electrical device and the base part via the plug-type connector that is attached to the electrical device and via the mating plug-type connector that is located on the base part. The electrical device can be, for example, an automatic parking ticket dispenser, an information terminal or a turnstile of a pedestrian access which is attached to a mounting foundation which is used as the base part. The electrical device can easily also be a charging station for motor vehicles, a gambling machine or a lighting mast. It is common to all these electrical devices that they are relatively large and heavy devices which cannot be placed on the base part or can be only placed with effort and possibly with several individuals by hand. Moreover, the mounting or guide aids that are formed between the electrical device and the base part—for slipping or pushing the electrical device onto the base part, can have mounting tolerances which are much larger than the mounting or location tolerances with which the plug-type connector can be connected to the corresponding mating plug-type connector. This leads to the electrical connection for such large and heavy electrical devices to a stationary base part not being able to take place or only being able to take place with greater difficulties by means of plug-type connections, especially high-pin plug-type connections.

German Patent DE 38 09 605 C2 discloses an electrical device which has several modules accommodated in the housing in the form of circuit boards, a wiring backplane which connects the circuit boards electrically to one another as well as a back panel and a front panel, the inner surface of the front panel likewise having electrical modules. The electrical connection between the modules of the front panel and the circuit boards which are located in the actual housing of the device takes place via plug-type connectors with socket and plug connectors which are located on the inside of the panel and the circuit boards. To compensate tolerances between the position of the socket connectors and the position of the corresponding plug connectors, the plug-type connectors that are located in the panel are supported in a floating manner. The tolerance compensation that can be achieved thereby is, however, only a few tenths of a millimeter; this is, however, sufficient in the known electrical device since, due to the relatively small size and low weight of the panel very accurate manual guidance of the panel is possible when plugging onto the housing.

German Patent DE 695 20 197 T2 and corresponding U.S. Pat. No. 6,017,233 discloses an arrangement for floating mounting of an electrical device on a plate, the electrical plug-type connector, in addition to a contact insert with several contact elements, has a lateral latch device which—like the contact insert—can be inserted through a larger opening in a mounting plate. Because the openings in the mounting plate are larger than the dimensions of the contact insert and the latch devices, considerable play is formed between the plug-type connector and the openings in the mounting plate so that "blind addition" of the plug-type connector through the openings in the plate is possible. To prevent the plug-type connector from being pulled unintentionally out of the mounting plate again, retaining caps are provided that have to be plugged onto the ends of the latch device which project through the openings in the plate from the side of the mounting plate opposite the plug-type connector.

The arrangement disclosed in German Patent DE 695 20 197 T2 and the corresponding U.S. Pat. No. 6,017,233 for floating mounting of a plug-type connector on a plate has the disadvantage that it can only be used where the plate is accessible after mounting of the plug-type connector from the back of the plate facing away from the plug-type connector, so that the retaining caps can be plugged onto the ends of the latch devices. Moreover the use of the additional retaining caps is disadvantageous both in production and also in mounting since there is the risk that the separate retaining caps will fall off or be lost.

Moreover, plug-type connectors which are supported in a floating manner are known from practice and have flexible fastening elements, as a result of which however only compensation of component and mounting tolerances in the range of a few tenth millimeters is possible; however this is generally adequate in the conventional field of electronics. Mounting tolerances of more than one millimeter cannot be compensated with these plug-type connectors, so that these plug-type connectors or plug-type connections cannot be used when relatively large and heavy electrical devices are to be connected to stationary base parts in which manual alignment of the plug-type connector halves directly to one another is not possible and in which the mounting tolerances of the device to the base part can be more than one millimeter.

SUMMARY OF THE INVENTION

Therefore, the object of this invention is to make provide an electrical device of the initially described type with a plug-type connector and an electrical plug-type connection consisting of a plug-type connector and a corresponding mating plug-type connector in which the above-described problems can be avoided as much as possible and compensation of relatively large mounting tolerances between the plug-type connector and the mating plug-type connector can be effected when the electrical device is joined to the stationary base part.

This object is achieved in the initially described electrical device in that the plug-type connector has at least one first guide element which when the electrical device is connected to the base part interacts with a second guide element which has been formed in the housing of the mating plug-type connector and that in the housing of the plug-type connector, the plug-type connector thus being fastened in a floating manner to a mounting plate of the device via at least one fastening screw which penetrates the screw hole, that the fastening screw has a screw head, a screw neck and a threaded screw end, the diameter of the screw head being larger than the diameter of the screw hole and the diameter of the screw neck being much smaller than the diameter of the screw hole.

The floating attachment of the plug-type connector to the mounting plate of the electrical device enables movement of the plug-type connector which compensates for a tolerance perpendicular to the joining direction of the electrical device, the plug-type connector being movable by the difference of the diameter of the screw hole and the diameter of the screw neck. If the diameter of the screw neck is much smaller than the diameter of the screw hole, a tolerance compensation of more than one millimeter, for example ±2 mm in all directions perpendicular or transversely to the joining direction, is possible.

The guide elements are preferably made as guide pins and guide holes, wherein preferably at least two guide pins are formed on the housing of the plug-type connector and two guide holes are formed in the housing of the mating plug-type connector. In the mechanical connection of the electrical device to the stationary base part, first the guide pins, whose free ends project over the front of the plug-type connector, initially engage the corresponding guide holes made in the housing of the mating plug-type connector. In further mating of the electrical device and stationary base part, then the plug-type connector is aligned with great precision to the mating plug-type connector by the plug-type connector being arranged floating perpendicular or transversely to the joining direction, i.e., movable within certain limits, on the mounting plate of the electrical device. When the guide pins are inserted into the guide holes, the housing of the plug-type connector is automatically pushed into the correct position so that the contact insert of the plug-type connector can be mated to the mating contact insert of the mating plug-type connector. Instead of the formation of one or more guide pins on the housing of the plug-type connector and corresponding guide holes in the housing of the mating plug-type connector, the mating plug-type connector can have corresponding guide pins and the plug-type connector can have corresponding guide holes.

According to one preferred configuration of the invention, the fastening screw has a screw stop limits the maximum screw-in path of the fastening screw into the mounting plate of the electrical device. This ensures that the screw head has some play relative to the housing of the plug-type connector in the axial direction of the fastening screw, so that the desired floating attachment of the plug-type connector to the mounting plate is not ruined by overly strong tightening of the fastening screw. To do this, the screw stop is located between the screw neck and the screw end such that the distance between the bottom of the screw head facing the screw neck and the bottom of the screw stop facing the screw end is slightly larger than the length of the screw hole in the housing of the plug-type connector. In other words, this means that the length of the screw neck and the thickness of the screw stop together are greater than the thickness of the housing of the plug-type connector in the region of the screw hole.

The screw stop is preferably made ring-shaped so that it completely surrounds the screw neck in the manner of a collar, the screw stop having an outside diameter which is much larger than the diameter of the screw neck and only somewhat smaller than the diameter of the screw head and the diameter of the screw hole. This yields a relatively large seating surface of the screw stop on the top of the mounting plate so that the fastening screw can be tightened with relatively high torque. This ensures that the plug-type connector is permanently and reliably attached to the mounting plate of the electrical device even under relatively severe ambient conditions, especially for large temperature fluctuations.

To prevent the maximum possible mobility of the plug-type connector perpendicular to the joining direction of the electrical device from being reduced by the larger outside diameter of the above described screw stop, an opening is formed in the housing of the plug-type connector on the end of the screw hole facing the mounting plate of the device that has a diameter that is greater than the diameter of the screw hole. The formation of such a larger diameter opening that adjoins the screw hole ensures that the desired mobility of the plug-type connector transversely to the joining direction is determined by the difference of the diameter of the screw hole and the diameter of the screw neck and is not dependent on the outside diameter of the screw stop.

It was stated above that the electrical device which can, for example, be an automatic parking ticket dispenser, an information terminal or a charging station for motor vehicles is mechanically connected to a stationary base part which is used as a mounting foundation. In order to simplify the mounting of such an electrical device with the base part, the electrical device according to one advantageous configuration has at least two guide aids which run perpendicular to the mounting plate and which interact with corresponding guide aids when the device is connected to the stationary base part. The guide aids provided on the electrical device can be, for example, guide crosspieces and the guide aids that have been made on the stationary base part can be corresponding guide grooves.

The aforementioned object is achieved in an initially described electrical plug-type connection according to the features that at least one screw hole is formed in the housing of the plug-type connector through which a fastening screw, which penetrates the screw hole, can be screwed into a bore in a mounting plate of an electrical device and that the fastening screw has a screw head, a screw neck and a threaded screw end, the diameter of the screw head being larger than the diameter of the screw hole and the diameter of the screw neck being much smaller than the diameter of the screw hole.

As already mentioned above in conjunction with the electrical device as claimed in the invention, compensation of mounting tolerances between the plug-type connector that can be fastened to an electrical device and the mating plug-type connector, that can be fastened to a stationary base part, is implemented by a floating support of the plug-type connector on the electrical device and on a mounting plate of the electrical device. Due to the formation of at least one screw hole and the special configuration of the fastening screw with a narrow screw neck, a movement of the plug-type connector perpendicular or transversely to the joining direction is possible which is limited by the difference of the diameter of the screw hole and the diameter of the screw neck. The narrower the screw neck and the larger the diameter of the screw hole, the larger the maximum possible offset between the plug-type connector and the mating plug-type connector that can be compensated when the plug-type connector and the mating plug-type connector are joined or when the electrical device is slipped or pushed onto the base part by the transverse motion of the plug-type connector that has been intentionally enabled.

As was likewise stated above in conjunction with the electrical device in accordance with the invention, the fastening screw preferably has a screw stop by which the maximum screw-in path of the fastening screw is limited so that the plug-type connector can be connected to the mounting plate with sufficient play in the axial direction and the intentional floating support of the plug-type connector is not adversely affected.

In order to automatically achieve alignment of the plug-type connector to the mating plug-type connector as accurately as possible in the joining process, the plug-type connector preferably has two guide pins and the mating plug-type connector has two corresponding guide holes, the guide pins and the guide holes being arranged diagonally relative to one another in the plane perpendicular to the joining direction of the plug-type connector. The automatic engagement of the guide pins with the guide holes is preferably further improved by the guide pins having conical tips so that the guide pins slide over the conical tips into the guide holes even with an initial offset of their longitudinal axes to the longitudinal axes of the guide hole.

According to another advantageous configuration of the electrical plug-type connection, the plug-type connector has several contact inserts with different contact elements and the mating plug-type connector has several mating contact inserts with different mating contact elements which, however, correspond to the assigned contact elements. Here, preferably at least one contact insert and one mating contact insert are provided for power supply and at least one contact insert and one mating contact insert are provided for data transmission from the electrical device to the base part and vice versa. The electrical plug-type connection as claimed in the invention is thus preferably a hybrid plug-type connection, i.e. a combination of plug-type connection for power supply and plug-type connection for data transmission. Even in such an electrical plug-type connection that has a plurality of contact elements and corresponding mating contact elements, only very small component and mounting tolerances are allowable between the plug-type connector and the mating plug-type connector. If a plug-type connector of such an electrical plug-type connection is fastened to a relatively large and heavy electrical device, the relatively large component and mounting tolerances that are allowable between the stationary base part and the electrical device must be compensated by the floating support of the plug-type connector so that the individual contact insert of the plug-type connector can be perfectly mated to the corresponding mating contact inserts of the mating plug-type connector.

In this electrical plug-type connection according to a last advantageous configuration of the invention, the mating plug-type connector additionally has a printed-circuit board and at least one coding element in addition to the mating contact inserts, the coding element being connected via the printed-circuit board to the mating contact elements of one contact insert for data transmission.

If the plug-type connector is attached to an electrical device, for example an automatic parking ticket dispenser that is mounted on a mounting foundation as base part, it can be necessary that a certain coding is set for identification of the exact position of the automatic parking ticket dispenser which then, together with the data from the automatic parking ticket dispenser, is transmitted to a central computer via a bus connection which is connected to the base part, for example an Ethernet connection. To set the corresponding coding on site, there is at least one coding element on the mating plug-type connector, which is set accordingly by the installer before the automatic parking ticket dispenser is slipped on the base part which is used as the mounting foundation. The coding element can preferably be several rotary switches that are mounted on the printed-circuit board located in the mating plug-type connector.

In particular there are a host of possibilities for embodying and developing the electrical device according to the invention and the electrical plug-type connection according to the invention. In this respect, reference is made to the following description of a preferred exemplary embodiment in conjunction with the drawings.

DETAILED DESCRIPTION OF THE INVENTION

Figure 1:
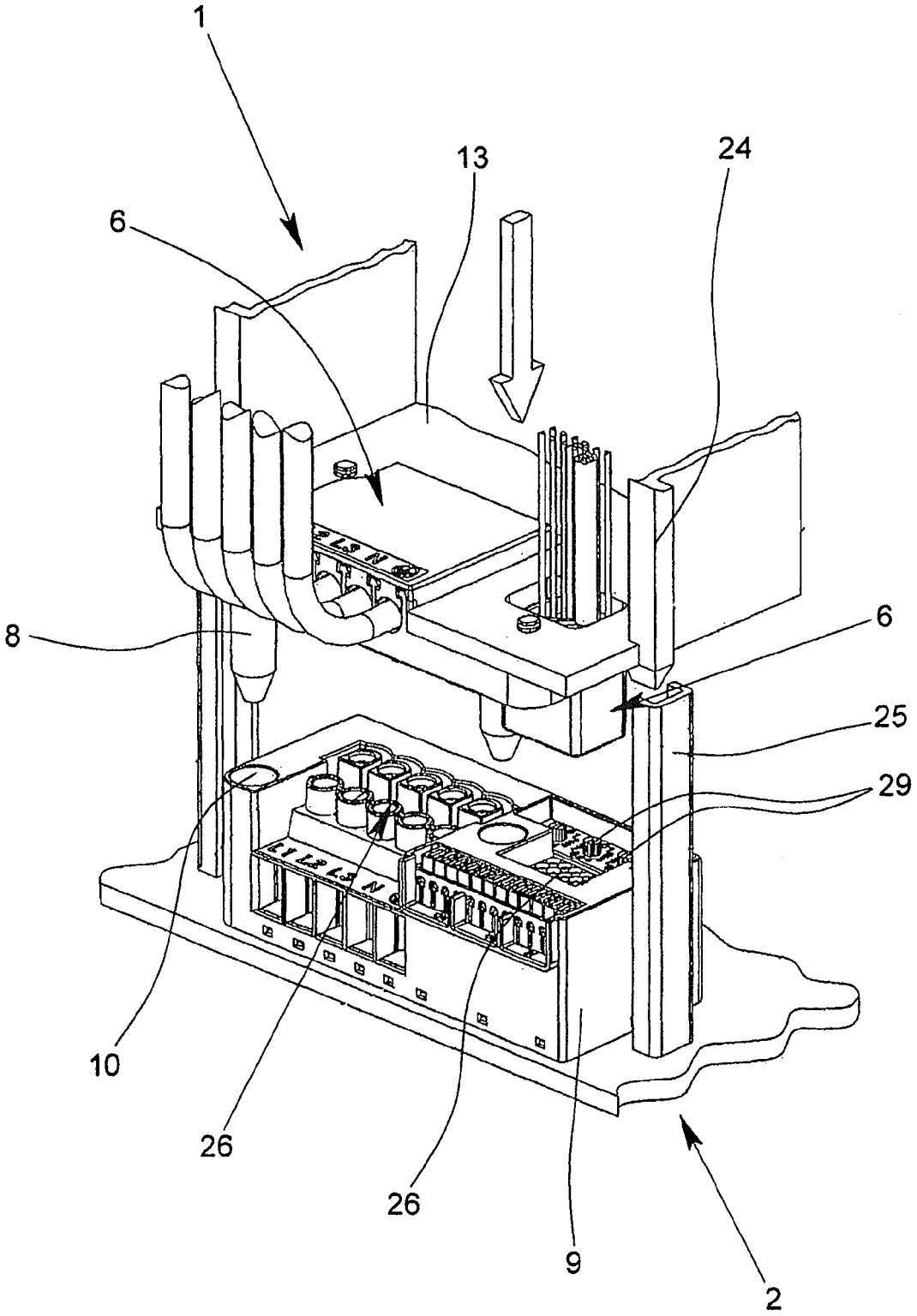
FIG. 1 shows a perspective of a plug-type connection in accordance with the invention in the not yet assembled state.
Figure 2:
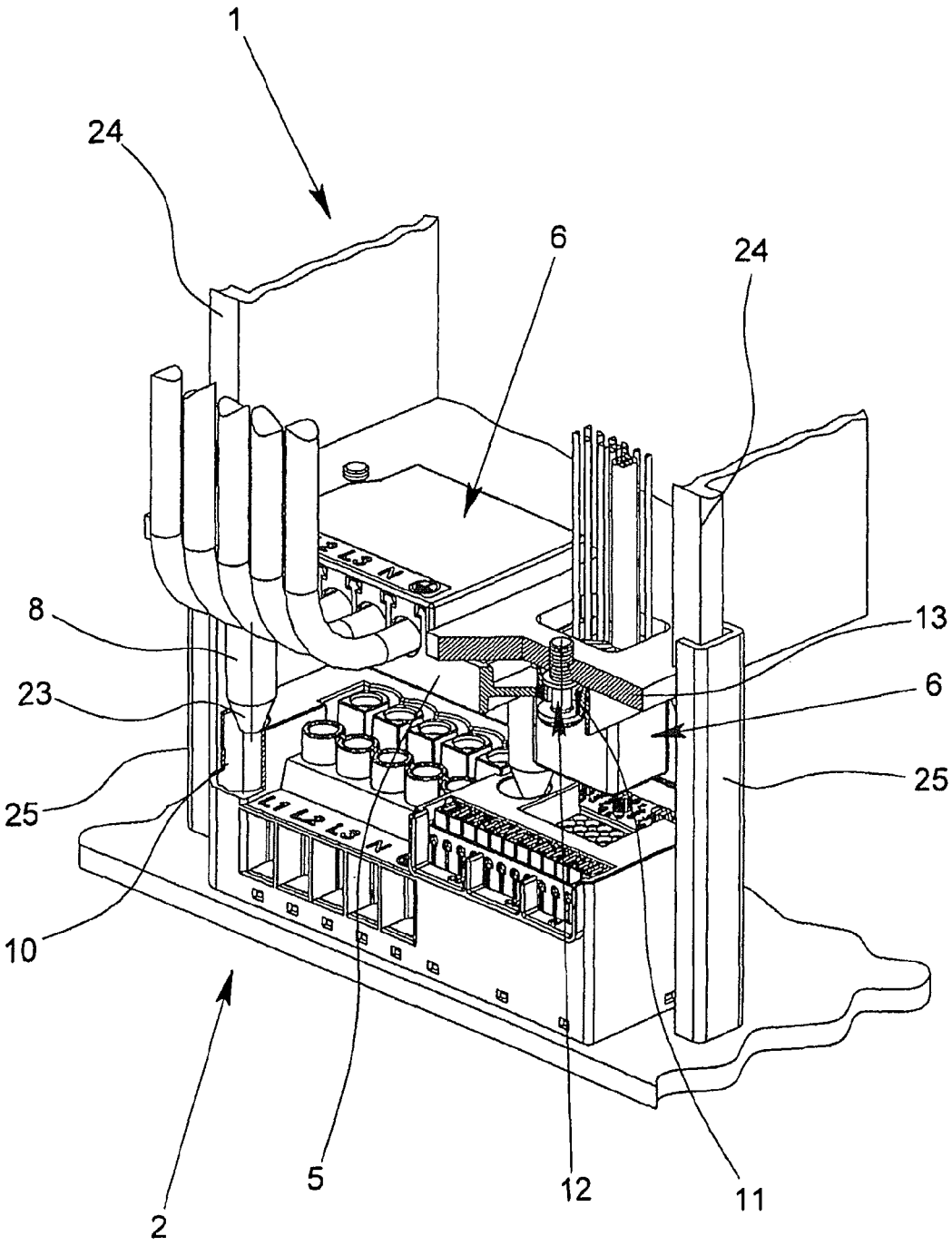
FIG. 2 shows the plug-type connection according to FIG. 1, partially cut away.
Figure 3A:
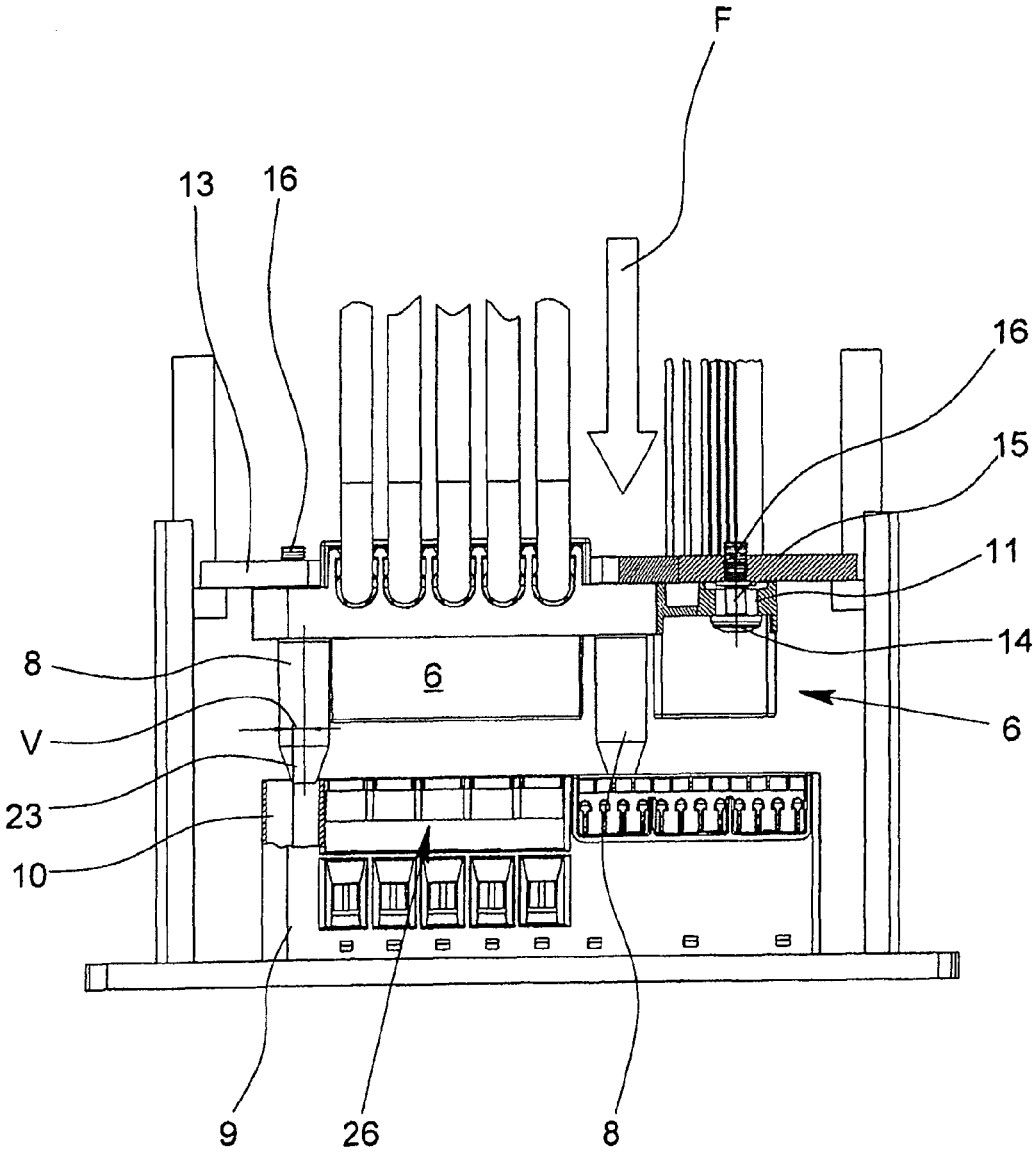
FIG. 3 shows the plug-type connection according to FIG. 2, at three successive points in time during assembly, in a side view.

FIGS. 1 to 3 each show an extract of an electrical device 1 that can be slipped onto a stationary base part 2, only one extract of the stationary base part 2 being shown. The figures show especially a plug-type connector 3 that has been fastened to the electrical device 1 and a corresponding mating plug-type connector 4 which has been fastened to the base part 2, when the electrical device 1 is completely connected to the stationary base part 2, the plug-type connector 3 and the mating plug-type connector 4 also being mated.

The plug-type connector 3 has a housing 5 with two contact inserts 6, the two contact inserts 6 each having a plurality of contact elements 7. Moreover, the plug-type connector 3 has two guide pins 8 which, when the electrical device 1 is connected to the base part 2, engage two guide holes 10 made in the housing 9 of the mating plug-type connector 4. Since the guide pins 8 project over the face side of the plug-type connector 3 or of the contact inserts 6 which faces the mating plug-type connector 4, the guide pins 8 initially engage the guide holes 10 when the electrical device 1 and base part 2 are joined, as a result of which alignment of the plug-type connector 3 which is floatingly attached to the device 1 to the mating plug-type connector 4, as is especially apparent in the three representations of FIG. 3 and which is explained in greater detail below.

The floating attachment of the plug-type connector 3 to the electrical device 1 is implemented by two screw holes 11 being formed in the housing 5 of the plug-type connector 3; they are each penetrated by a fastening screw 12 which is screwed into the mounting plate 13 of the device 1. The fastening screw 12 that is shown enlarged in FIG. 4 has a screw head 14, a screw neck 15 and a threaded screw end 16 which is screwed into a corresponding bore in the mounting plate 13. While the diameter of the screw head 14 is slightly larger than the diameter of the screw hole 11, the diameter of the screw neck 15 is much smaller than the diameter of the screw hole 11, preferably only roughly half as large; this leads to the plug-type connector 3 being movable relative to the mounting plate 13 and thus to the electrical device 1 by the difference of the diameter of the screw hole 11 and the diameter of the screw neck 14. In the illustrated exemplary embodiment, this difference is roughly ±2 mm in all directions perpendicular to the longitudinal axis of the fastening screw 12.

Figure 4:
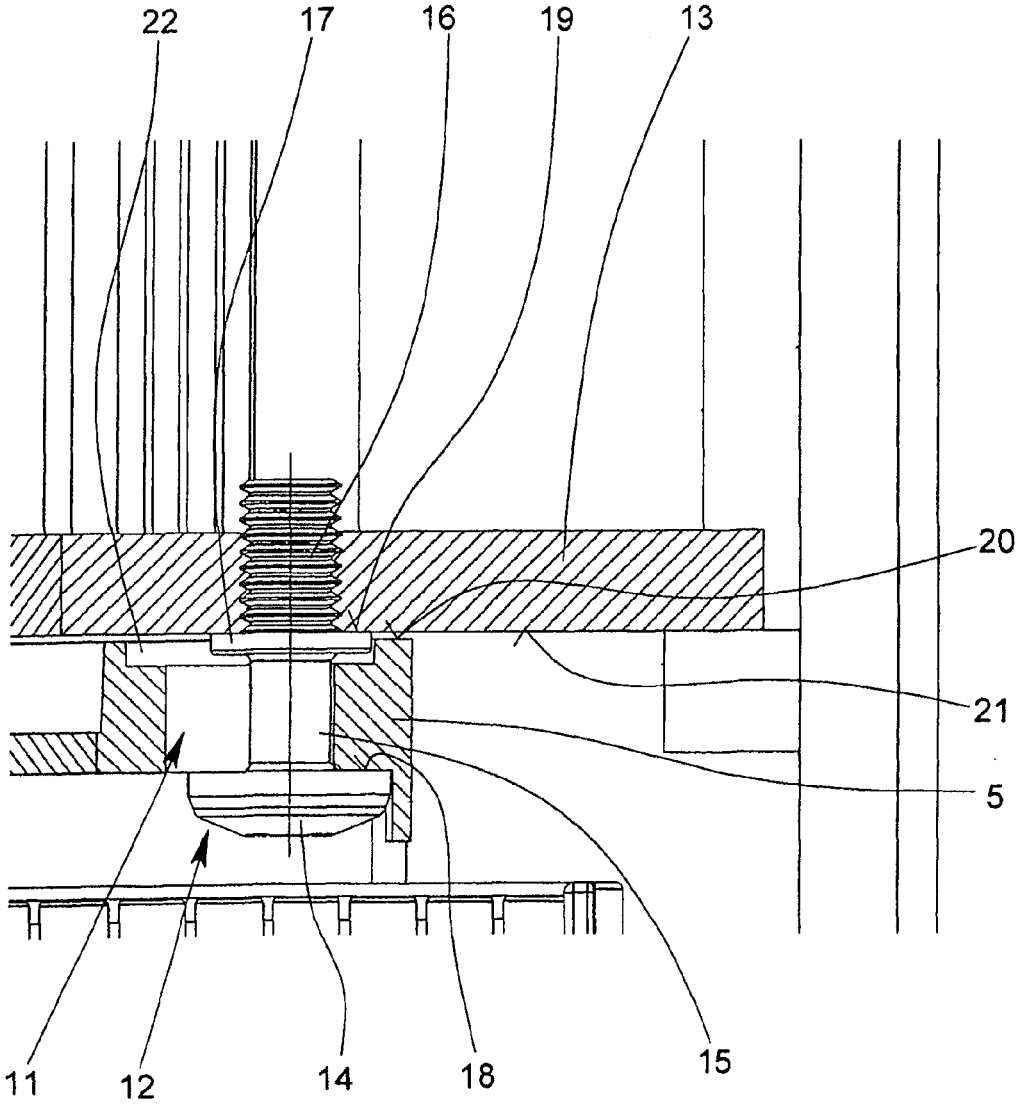
FIG. 4 shows a detailed extract of the plug-type connector.

In addition to the screw head 14, the screw neck 15 and the screw end 16, the fastening screws 12 have a ring-shaped screw stop 17 which is located between the screw neck 15 and the screw end 16 and limits the maximum screw-in depth of the fastening screw 12 into the mounting plate 13 such that the screw head 14 has some play in the axial direction of the fastening screw 12 to the housing 4 of the plug-type connector 3. For this purpose, the length of the screw neck 15 and the thickness of the screw stop 17 are chosen such that the distance between the bottom 18 of the screw head 14 facing the screw neck 15 and the bottom 19 of the screw stop 17 facing the screw end 16 is slightly larger than the length of the screw hole 11. As FIG. 4 shows, in the state of the fastening screw 12 screwed completely and tightly into the mounting plate 13 between the bottom 20 of the housing 5 facing the mounting plate 13 and the opposite top 21 of the mounting plate 13, there is a gap so that the desired floating support of the plug-type connector 3 on the mounting plate 13 is not ruined even with the fastening screw 12 screwed in tightly and completely.

The ring-shaped screw stop 17 that surrounds the screw end 16 in the manner of a collar has an outside diameter that is much greater than the diameter of the screw end 16 and of the screw neck 15. This yields a relatively large support surface of the screw stop 17 on the top 21 of the mounting plate 13 so that the fastening screw 12 can be tightened with a relatively large torque. This ensures reliable and permanent attachment of the plug-type connector 3 to the electrical device 1 even if the electrical device 1, due to relatively severe ambient conditions, is exposed to relatively large temperature fluctuations. So that the desired maximum possible travel of the plug-type connector 3 perpendicular to the joining direction F of the plug-type connector 3 shown in FIG. 3 is not reduced by the larger outside diameter of the screw stop 17, in the housing 5 of the plug-type connector 3 on the end of the screw hole 11 facing the mounting plate 13 an opening 22 is formed whose diameter is greater than the diameter of the screw hole 11. The maximum possible travel of the plug-type connector 3 is thus limited by the difference of the diameter of the screw hole 11 and the diameter of the screw neck 15 and not by the greater outside diameter of the screw stop 17.

Automatic alignment of the plug-type connector 3 to the mating plug-type connector 4 when the electrical device 1 is slipped or pushed onto the base part 2 is explained below in conjunction with FIG. 3, FIG. 3 showing three successive mounting steps.

At the start of the mounting process (FIG. 3*a*), the conical tips 23 of the two guide pins 8 engage the guide holes 10 made on the mating plug-type connector 4. As is apparent from FIG. 3*a*, due to the mounting and component tolerances between the guide crosspieces 24 formed on the electrical device 1 and the guide grooves 25 provided on the base part 2, an offset V can occur between the middle axis of the guide pins 8 and the middle axis of the guide holes 10. For a tight, non-floating attachment of the plug-type connector 3 to the electrical device 1, this would lead to the plug-type connector 3 not being able to be mated to the mating plug-type connector 4 since the allowable mounting tolerances between the plug-type connector 3 and the mating plug-type connector 4 are much smaller than the mounting tolerances between the electrical device 1 and the base part 2.

Due to the conical tip 23 of the guide pins 8, they travel into the guide holes 10 as the guide crosspieces 24 of the device 1 continue to be pushed into the guide grooves 25 of the base part 2 in spite of the offset; this leads to transverse shifting of the plug-type connector 3 perpendicular to the joining direction F. The floating attachment of the plug-type connector 3 to the mounting plate 13 of the device 1 thus makes it possible for the plug-type connector 3 to be shifted relative to the mounting plate 13 by the automatic alignment of the guide pins 8 and guide holes 10 to one another so that the plug-type connector 3 can be mated to the mating plug-type connector 4 as the device 1 continues to be slipped onto the base part 2 (FIG. 3*c*).

Figure 3B:
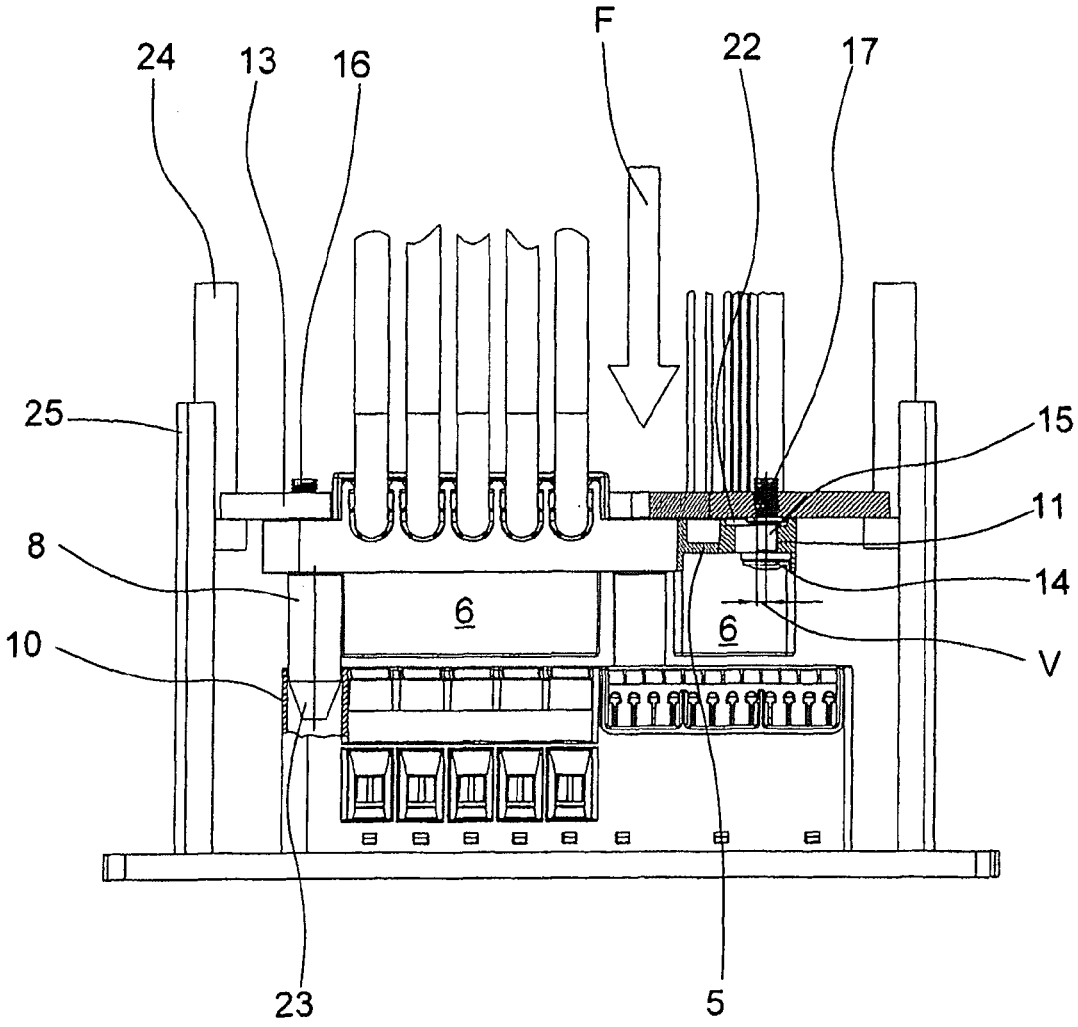
Figure 3C:
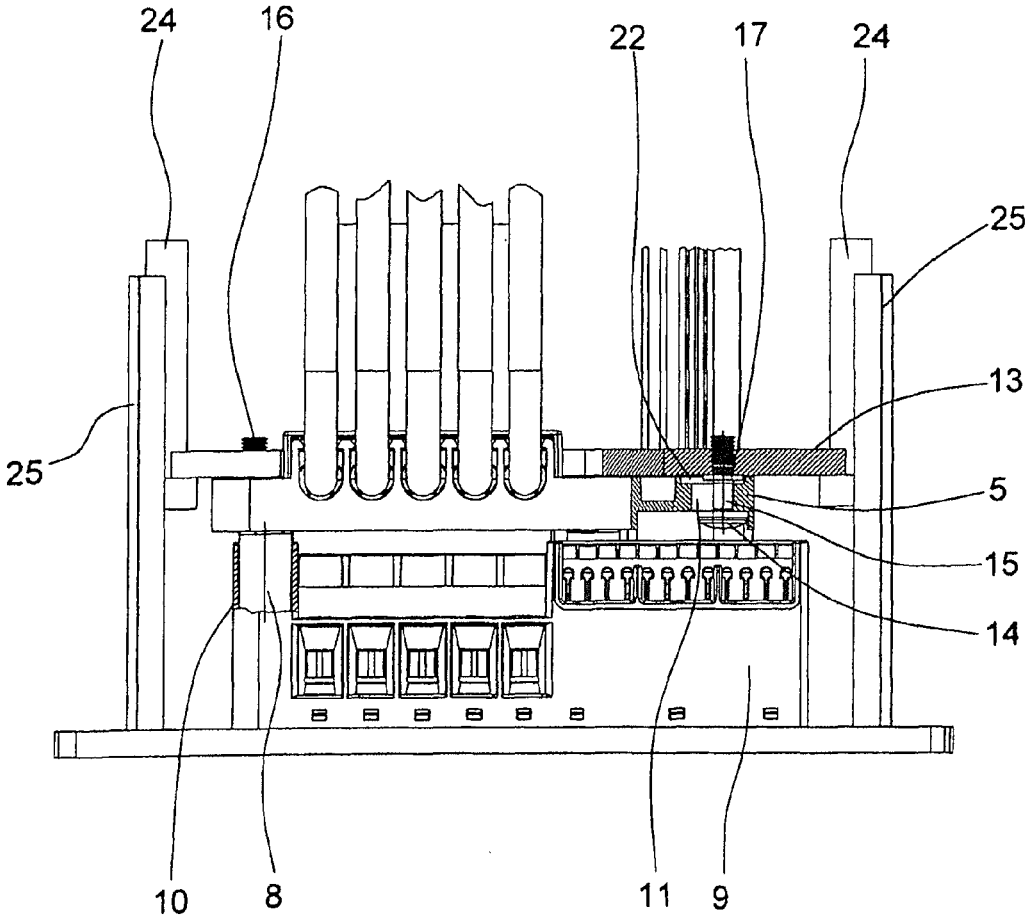

The offset compensation of the plug-type connector 3, which is necessary for this purpose, is enabled by the screw neck 15 of the fastening screw 12 being much narrower than the mounting hole 11 so that the plug-type connector 3 in FIG. 3*b* is shifted to the left relative to the fastening screw 12, which has been screwed tightly in the mounting plate 13. Thus the plug-type connector 3 is aligned at the same time to the mating plug-type connector 4 such that the contact inserts 6 with their contact elements 7 are aligned to the mating contact inserts 26 located in the mating plug-type connector 4 with their mating contact elements 27; mating of plug-type connector 3 and mating plug-type connector 4 is thus possible.

Figure 5:
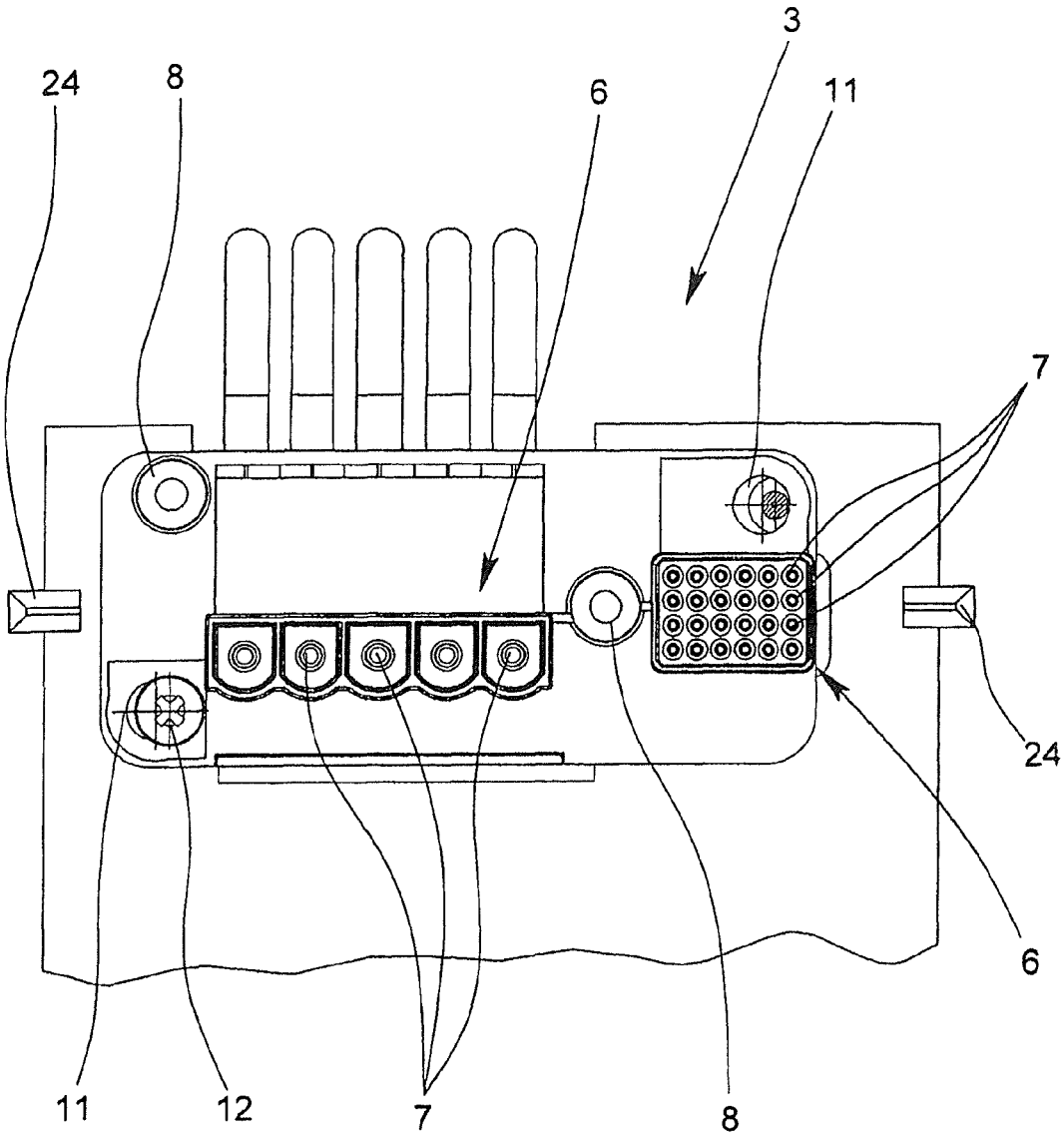
FIG. 5 shows the plug-type connector from underneath.

The depiction of the plug-type connector 3 according to FIG. 5 initially shows that the two screw holes 11 made in the housing 5 of the plug-type connector 3 are located diagonally offset to one another in the housing 5, especially in two diagonally opposite corners of the housing 5. Moreover FIG. 5 shows that the two guide pins 8 are also located diagonally to one another on the housing 5, i.e. are located offset to one another both in the longitudinal direction and also in the transverse direction of the plug-type connector 3.

In the exemplary embodiment of the electrical device 1 in accordance with the invention shown in the figures, the plug-type connector 3 has one contact insert 6 for power supply of the electrical device 1 with a total of five contact elements 7 and five terminals and one contact insert 6 with a plurality of contact elements 7—in this case 24 contact elements 7—for data transmission of the electrical device 1. Corresponding thereto the mating plug-type connector 4 also has a mating contact insert 26 for the power supply and a mating contact insert 26 for data transmission. The plug-type connector 3 and the mating plug-type connector 4 thus form a hybrid plug-type connection, with which both the electrical supply of the electrical device 1 and also the data transmission from and to the electrical device are implemented.

Figure 6:
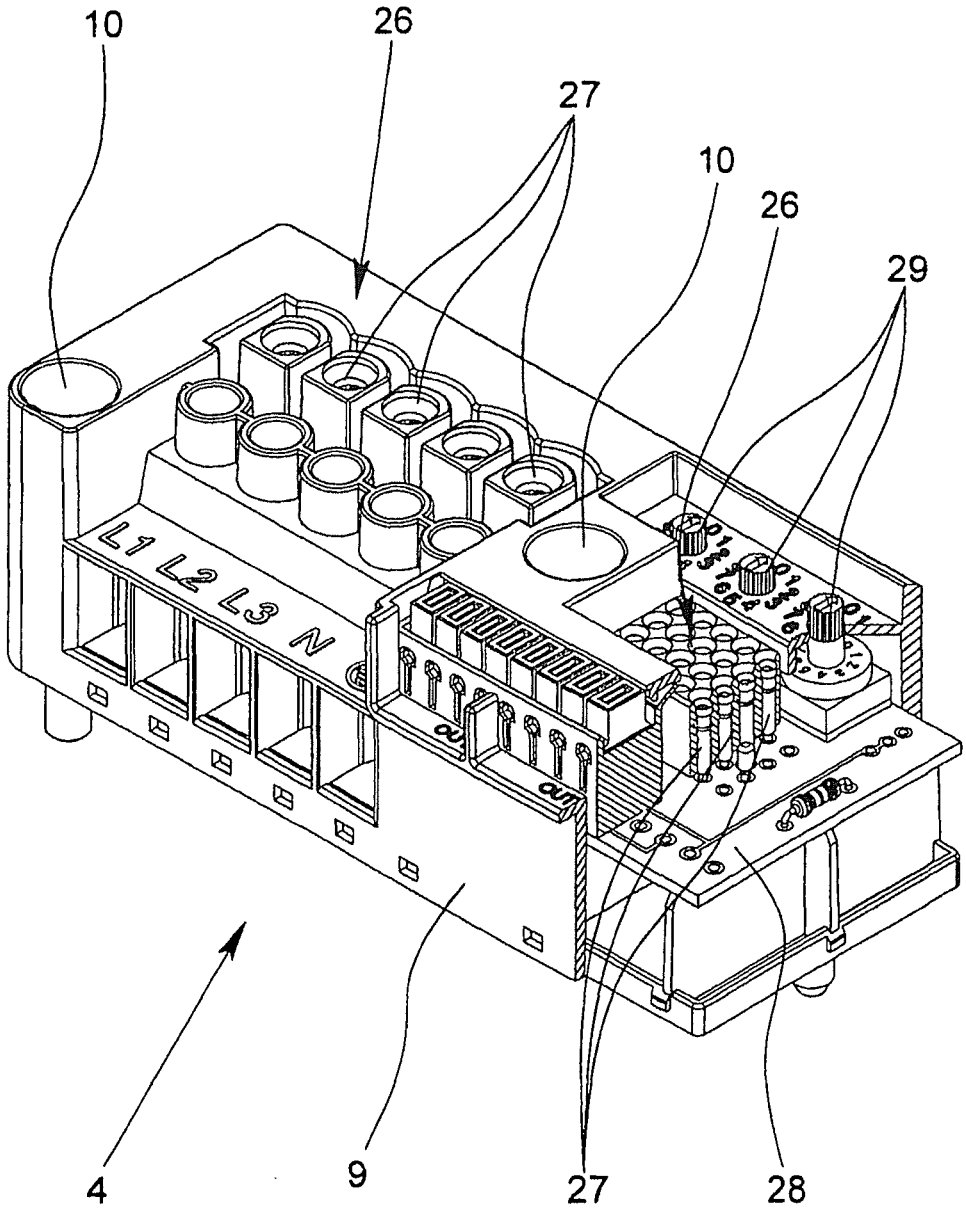
FIG. 6 shows a perspective plan view of the mating plug-type connector, partially cut away.

As FIG. 6 shows, in addition to the two mating contact inserts 26 for power supply and data transmission, the mating plug-type connector 4 additionally has a printed-circuit board 28 and a total of three coding elements 29, the coding elements 29 being connected via the printed-circuit board 28 to the mating contact elements 27 of the contact insert 26 for data transmission. Via the coding elements 29 which are made as rotary switches electrical coding can be set on site so that the data which are transmitted from the electrical device 1 via the plug-type connector 3 to the mating plug-type connector 4 and which are then relayed, for example, via an Ethernet connection to a central monitoring unit, can be assigned to a certain electrical device 1.

The electrical device 1, which is shown in the figures and to which the plug-type connector 3, is attached is a relatively large and heavy device which cannot be easily mounted by hand on the stationary base part 2 as the mounting foundation. The electrical device 1 can, be for example a turnstile of a pedestrian access, an information terminal or an automatic parking ticket dispenser. If the electrical device 1 is, for example, an automatic parking ticket dispenser, a coding corresponding to the position of the automatic parking ticket dispenser can be set by the installer via the coding elements 29 formed in the mating plug-type connector 4 before mounting of the automatic parking ticket dispenser, a coding which corresponds to the position of the automatic parking ticket dispenser can be set by the installer so that the data transmitted to a central management site can be assigned to the "correct" automatic parking ticket dispenser.

What is claimed is:

1. An electrical device for mechanical and electrical connection to a stationary base part, comprising:

a mounting plate, a plug connector which is connectable to a corresponding mating plug connector attached to the base part, the plug connector having a housing with at least one contact insert having several contact elements, wherein the plug connector has at least one first guide element which, when the electrical device is connected to the base part, interacts with a second guide element in a housing of the mating plug connector, wherein at least one screw hole is formed in the housing of the plug connector, the plug connector being attached in a floating manner to the mounting plate via at least one fastening screw which penetrates the at least one screw hole, wherein the at least one fastening screw has a screw head, a screw neck and a threaded screw end, the diameter of the screw head being larger than the diameter of the screw hole and the diameter of the screw neck being smaller than the diameter of the screw hole to an extent enabling movement of the fastening screw within the screw hole in a radial direction, wherein the fastening screw has a screw stop which is located between the screw neck and the threaded screw end, wherein the screw stop is ring-shaped and has an outside diameter which is larger than the diameter of the screw neck and only smaller than the screw hole and wherein at least one of a length of the screw neck and a thickness of the screw stop are such that a distance between a bottom of the screw head facing the screw neck and a bottom of the screw stop facing the screw end is larger than a length of the screw hole through the housing of the plug connector, and wherein in the housing of the plug connector an opening is formed on an end of the screw hole facing the mounting plate that has a diameter which is greater than the diameter of the screw hole.

2. The electrical device as claimed in claim 1, wherein the screw stop is ring-shaped and has an outside diameter which is larger than the diameter of the screw neck and only smaller than the diameter of the screw hole.

3. The electrical device as claimed in claim 1, wherein said at least one screw hole comprises two screw holes that are located diagonally offset relative to one another in a plane perpendicular to a joining direction.

4. The electrical device as claimed in claim 3, wherein the at least one first guide element comprises guide pins that have a conical tip and are located diagonally offset relative to one another in the plane perpendicular to the joining direction.

5. The electrical device as claimed in claim 1, further comprising at least two guide aids which run perpendicular to the mounting plate which, when the device is connected to the stationary base part, interact with corresponding guide aids on the base part.

6. The electrical device as claimed in claim 5, wherein the plug connector is attached so as to be hidden in a joining direction when the device is connected to the stationary base part preventing manual alignment of the plug connector relative to the mating plug connector.

7. The electrical device as claimed in claim 1, wherein the at least one contact insert comprises a plurality of contact inserts with different contact elements, at least one of the contact inserts being provided for supplying power to the device and at least one of the contact inserts being provided for data transmission.

8. An electrical plug connection for producing an electrical connection between an electrical device and a stationary base part, comprising:

a plug connector that is attachable to a mounting plate in a floating manner, and a corresponding mating plug connector which is attachable to the base part, wherein the plug connector has a housing with at least one contact insert having a plurality of contact elements and at least one first guide element, wherein the mating plug connector has a housing with at least one mating contact insert having a plurality of mating contact elements and at least one second guide element which interacts with said at least one first guide element when the plug connector and the mating plug connector are joined, wherein at least one screw hole is formed in the housing of the plug connector through which a fastening screw penetrates for being screwed into a bore in the mounting plate, wherein the fastening screw has a screw head, a screw neck and a threaded screw end, the diameter of the screw head being larger than the diameter of the screw hole and the diameter of the screw neck being smaller than the diameter of the screw hole to an extent enabling movement of the fastening screw within the screw hole in a radial direction, wherein the fastening screw has a screw stop which is located between the screw neck and the threaded screw end and wherein at least one of a length of the screw neck and a thickness of the screw stop are such that a distance between a bottom of the screw head that faces the screw neck and a bottom of the screw stop that faces the screw end is larger than a length of the screw hole through the housing of the plug connector, the screw stop being ring-shaped and having an outside diameter which is larger than the diameter of the screw neck and only smaller than the screw hole, and wherein the housing of the plug connector has an opening on an end of the screw hole that faces away from the screw head that has a diameter that is greater than the diameter of the screw hole.

9. The electrical plug connection as claimed in claim 8 wherein said at least one first guide element comprises two guide pins having one conical tip and wherein the at least one second guide element comprises two guide holes, the guide pins being located diagonally offset relative to one another in a plane perpendicular to a joining direction of the plug connector and the guide holes being located diagonally offset relative to one another in a plane perpendicular to the joining direction of the plug connector.

10. The electrical plug connection as claimed in claim 8, wherein the plug connector has a plurality of contact inserts with different contact elements, and wherein the mating plug connector has a plurality of mating contact inserts with different mating contact elements, each of which corresponds to a respective one of the contact elements, at least one contact insert and at least one mating contact insert being for power supply and at least one contact insert and at least one one mating contact insert being for data transmission.

11. The electrical plug connection as claimed in claim 10, wherein the mating plug connector has a printed-circuit board and at least one coding element, and wherein a coding element is connected to the mating contact elements of one of the mating contact inserts via the printed-circuit board for data transmission.

* * * * *